US006182462B1

(12) United States Patent
Bania et al.

(10) Patent No.: US 6,182,462 B1
(45) Date of Patent: Feb. 6, 2001

(54) INTERNALLY ILLUMINATED COOLER BOX

(76) Inventors: Craig M. Bania, 74 Wickham La., Wallingford, VT (US) 05773; Daniel R. Blanchard, Sr., 199 Mussey St., Rutland, VT (US) 05701

( * ) Notice: Under 35 U.S.C. 154(b), the term of this patent shall be extended for 0 days.

(21) Appl. No.: 09/431,873

(22) Filed: Nov. 2, 1999

(51) Int. Cl.[7] ..... F25D 23/00
(52) U.S. Cl. ..... 62/264; 62/457.7
(58) Field of Search ..... 62/264, 457.7; 220/212; 362/155, 156

(56) References Cited

U.S. PATENT DOCUMENTS

| | | | | |
|---|---|---|---|---|
| 867,317 | | 10/1907 | Stevenson . | |
| 1,895,864 | | 1/1933 | Ricci . | |
| 2,145,196 | | 1/1939 | Biggs . | |
| 2,604,579 | | 7/1952 | Deneboudes . | |
| 2,644,882 | | 7/1953 | Voda . | |
| 2,655,419 | | 10/1953 | Achs . | |
| 3,937,320 | * | 2/1976 | Chao et al. | 362/155 |
| 4,238,934 | | 12/1980 | Hotta . | |
| 4,498,312 | | 2/1985 | Schlosser . | |
| 4,571,740 | | 2/1986 | Kirby et al. . | |
| 4,667,484 | | 5/1987 | Tarozzi et al. . | |
| 4,719,765 | | 1/1988 | Hooper et al. . | |
| 4,939,912 | | 7/1990 | Leonovich, Jr. . | |
| 5,007,246 | | 4/1991 | Kruck et al. . | |
| 5,329,433 | * | 7/1994 | Geeting et al. | 362/155 |
| 5,768,898 | | 6/1998 | Seok et al. . | |

* cited by examiner

*Primary Examiner*—Corrine McDermott
*Assistant Examiner*—Mohammad M Ali
(74) *Attorney, Agent, or Firm*—John J Welch Jr. Esq.

(57) ABSTRACT

The instant invention is a cooler box internally illuminated by way of an illuminating system built into inner walling of the lid of the box for one embodiment thereof and into inner walling of the box itself for a second embodiment thereof, the system consisting of current conducting circuitry by way of which a manual switch, an automatic spring loaded switch, seating means holding an incandescent light bulb and seating means holding a portable, energized battery unit are all interconnected within compartments within such walling and over the exterior of each of which compartments, a translucent plate and a second plate are respectively removably affixed.

2 Claims, 3 Drawing Sheets

INTERNALLY ILLUMINATED COOLER BOX

B CROSS REFERENCE TO PRIOR OR PARENT APPLICATIONS

There are no prior or parent applications to which the instant invention relates.

C FEDERALLY SPONSORED RESEARCH AND DEVELOPMENT

There is no federally sponsored research and development to which the instant invention relates.

D BACKGROUND OF THE INVENTION

1. Field of the Invention

The instant invention relates to that category of portable devices which are utilized to temporarily store foods and beverages at cool temperatures.

2. Related Art

The Art Informational Statement submitted herewith refers to art that however does not anticipate the instant invention.

E A SUMMARY OF THE INVENTION

1. A Brief Description of the Invention

The instant invention is a portable four-sided cooler box for temporarily storing food and beverages at cool temperatures within which there is to be found an internally positioned illuminating system. The system is locatable within the inner walling of the box or within the inner walling of a lid hingeably attached to such a cooler box. The system consists of an incandescent light bulb held in seating means within one compartment within such inner walling over the front of which, a translucent plate is removably affixable. It further consists of a portable, oversized battery unit held in seating means within a second compartment within such inner walling over the front of which, a second plate is removably affixable. It further consists of a manually operable switch and a spring loaded automatic switch. The battery unit, bulb holding seating means, and switches are connected by wiring to form a current conducing circuit.

2. Object of the Invention

It is oftentimes necessary for persons on an outdoor camping or picnic trip to open a cooler box containing food and beverages at nighttime. The instant invention enables them to readily locate and identify items of food and beverages within the box in order to then extract some of the same from the box without any need to resort to the use of an extraneous light source. The instant device in this regard is unquestionably useful under circumstances where an extraneous light source is either not readily available or indeed not available at all.

F A DESCRIPTION OF THE DRAWINGS

Figure 1:
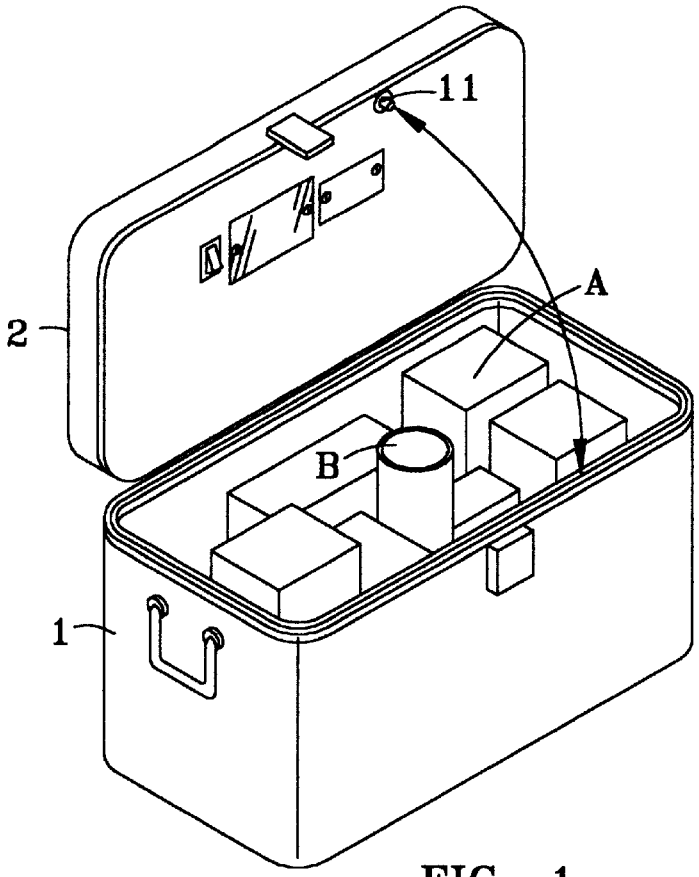

1. FIG. 1 is a perspective view of one embodiment of the invention.

Figure 2:
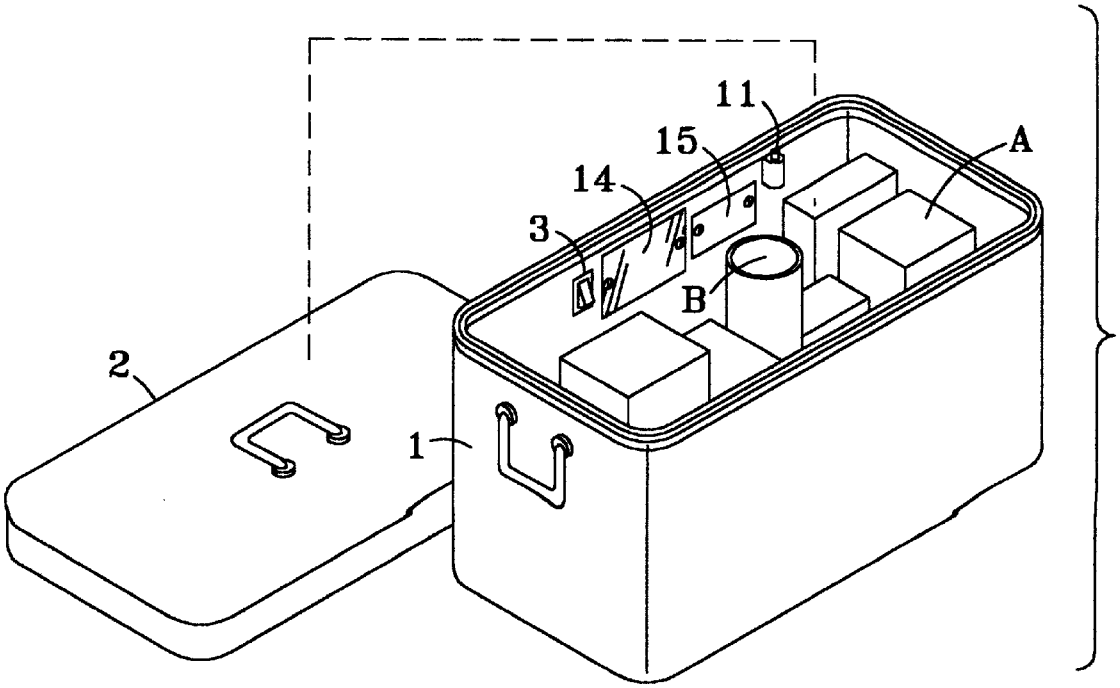

2. FIG. 2 is a perspective view of a second embodiment of the instant invention.

Figure 3:
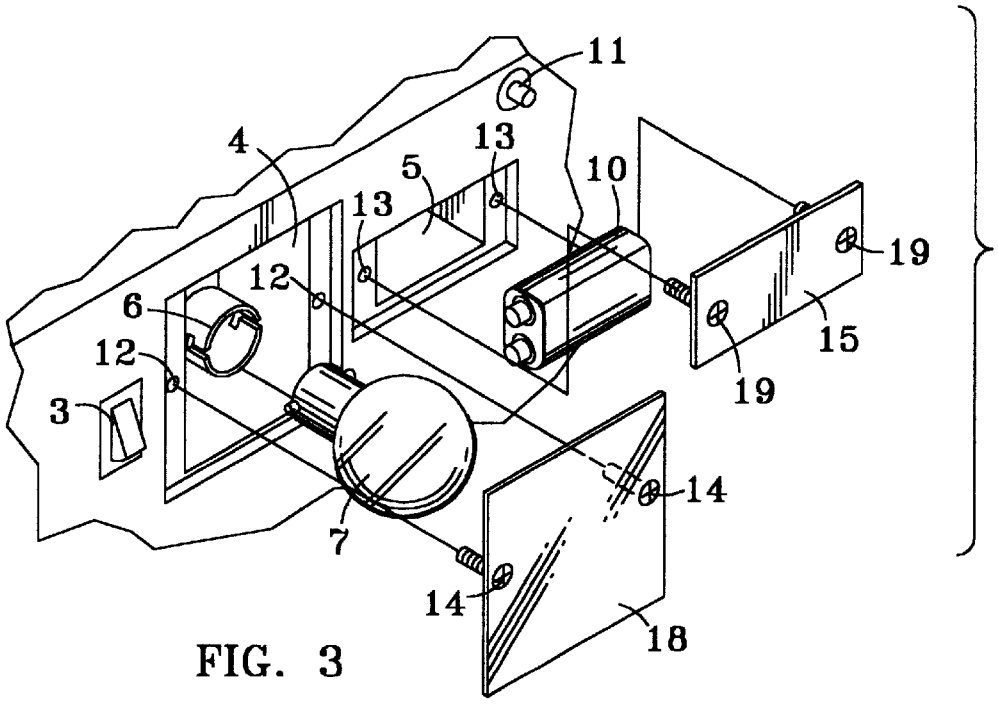

3. FIG. 3 is an exploded view of the illumination system of the instant invention.

Figure 4:
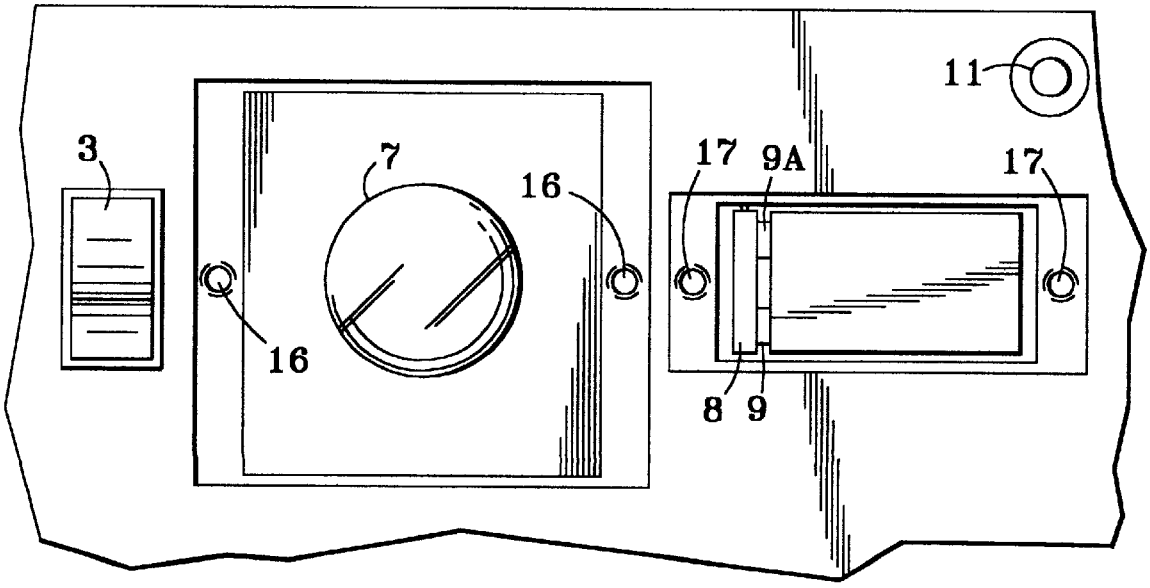

4. FIG. 4 is an isolated frontal plan view of the illumination system of the embodiment of the instant invention depicted in FIG. 1 absent the plate components thereof.

Figure 5:
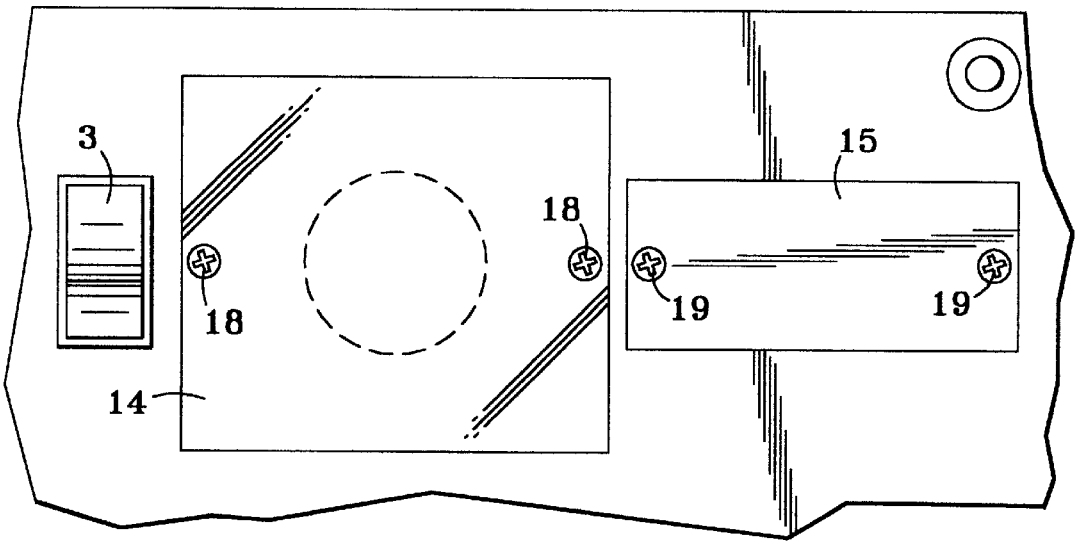

5. FIG. 5 is an isolated frontal plan view of the illumination system of the embodiment of the instant invention depicted in FIG. 1 with the plate components thereof affixed thereto.

Figure 6:
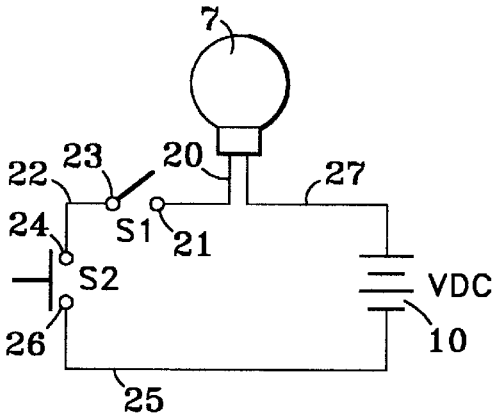

6. FIG. 6 is a schematic view of the circuitry of the illumination system with both switching mechanisms being in an off position.

Figure 7:
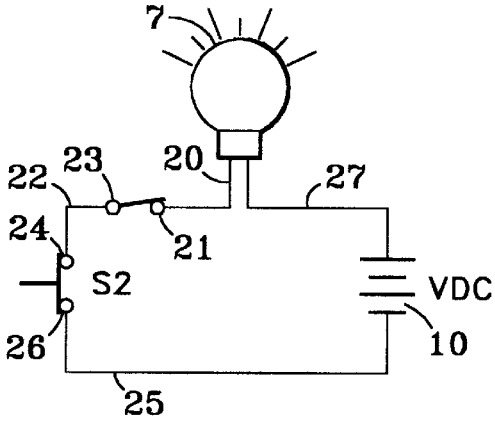

7. FIG. 7 is a schematic view of the circuitry of the illumination system with both switching mechanisms being in an on position.

G A DESCRIPTION OF THE PREFERRED EMBODIMENTS

FIGS. 1 and 2 are perspective views of the two embodiments of the instant invention. The two embodiments differ only that one embodiment shown in FIG. 1 is characterized by the presence of a hingeably affixed lid 2 affixed to an insulated hollowed out, four sided cooler box 1 while the embodiment shown in FIG. 2 is characterized by the presence of a completely removable lid 2. The illuminating system of the invention is found within inner walling of lid 2 in the first embodiment and is found within inner walling of box 1 in the second embodiment. The illuminating systems of each embodiment are one and the same differing only with respect to the location thereof within the invention. FIG. 3 is an exploded view of the illuminating system. A manually operable first switching mechanism 3 is affixed to the inner walling of lid 2 (first embodiment) or box 1 (second embodiment) near to a first compartment 4 located within such inner walling. A hollowed out second compartment 5 is also located within such inner walling. First seating means 6 for holding an incandescent light bulb 7 is located within and affixed to back walling of first compartment 5. Second seating means 8 for holding each of a pair of battery terminals 9 and 9A of an energized, portable battery unit is located within and affixed to lateral walling of second compartment 5. Second seating means 5 with terminals 9 and 9A inserted therein are shown in FIG. 4. An automatic spring loaded second switching mechanism 11 is also affixed within such inner walling. Switching mechanism 11 is always in the "off" position when lid 2 is down and covering box 1 in either embodiment, and; whereas mechanism 11 is spring loaded, it's always up and in the "on" position when lid 2 is up as respects box 1 in the first embodiment or as respects the second embodiment, when lid 2 is actually off from box 1. Switching mechanism 3 is off during daylight hours so as to prevent bulb 7 from coming on when lid 2 is up or off box 1 in either embodiment. In either embodiment, a first pair of closed holes 12 and a second pair of closed holes 13 are respectively drilled into such inner walling into anterolateral sides of compartments 4 and 5 respectively. A translucent plate 14 seen in FIGS. 3 and 5 is affixable to such inner walling over the exterior or frontal aspect of compartment 4. A second plate 15 as seen in FIGS. 3 and 5 is affixable to such inner walling over the exterior or frontal aspect of compartment 5. A first pair of screws s18 are inserted through a first pair of through holes 16 in plate 14 and in turn are screwed into holes 12 as seen in FIG. 5. A second pair of screws 19 are inserted through a second pair of through holes 17 in plate 15 and in turn are screwed into holes 13. In this way, the illuminating system is held intact within either embodiment.

The just previously described components of the illuminating system are connected to one another as can be appreciated with reference to FIGS. 6 and 7. As per FIG. 6, a first current conducting wire 20 is affixed to first seating means 6 and is connected to a first contact point 21 in switch 3. A second current conducting wire 22 is connected to and leads from a second contact point 23 in switch 3 and is in turn connected to a first contact point 24 in switching mechanism 11. A third current conducting wire 25 is connected to and leads from a second contact point 26 in second switch 11 and is connected to second seating means 5 holding terminal 9 of battery 10. A fourth current conducting wire 27 connected to and leading from second seating means 5 also holding terminal 9A of battery 10 is, in turn affixed to first seating means 6 adjacent affixation thereof of first wire 20.

In the nighttime, when switch 3 is in the "on" position, when one removes lid 2 from top edging of box 1 in either embodiment thereof causing previously depressed spring loaded switch 11 to assume an "on" position as depicted schematically in FIG. 7, the illuminating system of the invention provides the light needed to enable a person to visualize and then extract certain desired food A or beverages B stored in box 1 without any need for relying on any exterior light source to do so.

Plates 14 and 15 are readily removable and reattachable for purposes of enabling one to easily replace bulb 7 or battery 10. The instant invention is hence quite convenient to use.

In conclusion for the reasons cited above, it is respectfully submitted that the instant invention is indeed not only new and unique but also unquestionably useful.

H What is claimed is:

1. An Internally Illuminated Cooler Box, comprising:

a. an insulated hollowed out, four sided cooler box;

b. an insulated four sided lid hingeably affixed to said box;

c. a manually operable first switching mechanism affixed to inner walling of said box;

d. a hollowed out first compartment located within said inner walling;

e. a hollowed out second compartment located within said inner walling;

f. first seating means for holding an incandescent light bulb located within and affixed to back walling of said first compartment;

g. second seating means for holding each of a pair of battery terminals of an energized portable battery unit located within and affixed to lateral walling of said second compartment;

h. said incandescent light bulb being seated within said first seating means;

i. said battery unit being seated by way of said pair of terminals within said second seating means;

j. an automatic spring loaded second switching mechanism affixed to said inner walling of said box;

k. a first pair of closed holes drilled parallel to one another, a first one of said first pair being drilled into a first anterolateral side of said first compartment and a second one of said first pair being drilled into a second anterolateral side of said first compartment;

l. a second pair of closed holes drilled parallel to one another, a first one of said second pair being drilled into a first anterolateral side of said second compartment and a second one of said second pair being drilled into a second anterolateral side of said second compartment;

m. a translucent plate affixable to said inner walling over a frontal aspect of said first compartment;

n. a second plate component affixable to said inner walling over a frontal aspect of said second compartment, o. a first pair of oppositely positioned through holes within said translucent plate;

p. a second pair of oppositely positioned through holes within second plate component;

q. a first pair of screws, one of said first pair of screws being insertable through one of said first pair of through holes and into said first one of said first pair of closed holes and a second one of said first pair of screws being insertable through a second one of said first pair of through holes and into said second one of said first pair of closed holes;

r. a second pair of screws, one of said second pair of screws being insertable through one of said second pair of through holes and into said first one of said second pair of closed holes and a second one of said second pair of screws being insertable through a second one of said second pair of through holes and into said second one of said second pair of closed holes;

s. a first current conducting wire leading from an affixation thereof to said first seating means to and being connected to a first contact point in said first switching mechanism;

t. a second current conducting wire connected to and leading from a second contact point in said first switching mechanism to and being connected to a first contact point in said second switching mechanism;

u. a third current conducting wire connected to and leading from a second contact point in said second switching mechanism to and connected to a first one of said pair of battery terminals, and;

v. a fourth current conducting wire connected to and leading from a second one of said pair of battery terminals to and affixed to said first seating means adjacent affixation thereto of said first wire.

2. An Internally Illuminated Cooler Box, comprising:

a. an insulated hollowed out, four sided cooler box;

b. an insulated, four sided lid hingeably affixed to said box;

c. a manually operable first switching mechanism affixed to inner walling of said lid;

d. a hollowed out first compartment located within said inner walling;

e. a hollowed out second compartment located within said inner walling;

f. first seating means for holding an incandescent light bulb located within and affixed to back walling of said first compartment;

g. second seating means for holding each of a pair of battery terminals of an energized portable battery unit located within and affixed to lateral walling of said second compartment;

h. said incandescent light bulb being seated within said first seating means;

i. said battery unit being seated by way of said pair of terminals within said second seating means;

j. an automatic spring loaded second switching mechanism affixed to said inner walling of said box;

k. a first pair of closed holes drilled parallel to one another, a first one of said first pair being drilled into a first anterolateral side of said first compartment and a second one of said first pair being drilled into a second anterolateral side of said first compartment;

l. a second pair of closed holes drilled parallel to one another, a first one of said second pair being drilled into a first anterolateral side of said second compartment and a second one of said second pair being drilled into a second anterolateral side of said second compartment;

m. a translucent plate affixable to said inner walling over a frontal aspect of said first compartment;

n. a second plate component affixable to said inner walling over a frontal aspect of said second compartment;

o. a first pair of oppositely positioned through holes within said translucent plate;

p. a second pair of oppositely positioned through holes within second plate component;

q. a first pair of screws, one of said first pair of screws being insertable through one of said first pair of through holes and into said first one of said first pair of closed holes and a second one of said first pair of screws being insertable through a second one of said first pair of through holes and into said second one of said first pair of closed holes;

r. a second pair of screws, one of said second pair of screws being insertable through one of said second pair of through holes and into said first one of said second pair of closed holes and a second one of said second pair of screws being insertable through a second one of said second pair of through holes and into said second one of said second pair of closed holes;

s. a first current conducting wire leading from an affixation thereof to said first seating means to and being connected to a first contact point in said first switching mechanism;

t. a second current conducting wire connected to and leading from a second contact point in said first switching mechanism to and being connected to a first contact point in said second switching mechanism;

u. a third current conducting wire connected to and leading from a second contact point in said second switching mechanism to and connected to a first one of said pair of battery terminals, and;

v. a fourth current conducting wire connected to and leading from a second one of said pair of battery terminals to and affixed to said first seating means adjacent affixation thereto of said first wire.

* * * * *